US005383595A

United States Patent [19]

Hallam

[11] Patent Number: 5,383,595

[45] Date of Patent: Jan. 24, 1995

[54] BOXES

[75] Inventor: Derek Hallam, Bradford, England

[73] Assignee: Concept Packaging Limited, Bradford, United Kingdom

[21] Appl. No.: 87,818

[22] PCT Filed: Jan. 9, 1992

[86] PCT No.: PCT/GB92/00046

§ 371 Date: Jul. 8, 1993

§ 102(e) Date: Jul. 8, 1993

[87] PCT Pub. No.: WO92/12056

PCT Pub. Date: Jul. 23, 1992

[30] Foreign Application Priority Data

Jan. 10, 1991 [GB] United Kingdom ..... 9100501

[51] Int. Cl.[6] ..... B65D 3/14; B65D 3/28

[52] U.S. Cl. ..... 229/4.5; 229/23 R; 229/198.2; 229/116.1

[58] Field of Search ..... 229/4.5, 23 R, 190, 229/198.2, 8

[56] References Cited

U.S. PATENT DOCUMENTS

| | | | |
|---|---|---|---|
| 1,239,162 | 9/1917 | Cullen | 229/198.2 |
| 1,331,330 | 2/1920 | Erickson | 229/198.2 |
| 1,617,274 | 2/1927 | Romer | 229/198.2 |
| 1,947,190 | 2/1934 | Cody | 229/4.5 |
| 2,006,952 | 7/1935 | Klein | 229/4.5 |
| 2,133,629 | 10/1938 | Meyer | 229/198.2 |
| 2,140,932 | 12/1938 | Avery | 229/198.2 |
| 2,458,578 | 1/1949 | Evans | 229/4.5 |
| 2,596,218 | 5/1952 | Dennis | 229/4.5 |

FOREIGN PATENT DOCUMENTS

| | | | |
|---|---|---|---|
| 725455 | 5/1932 | France | 229/198.2 |
| 2836271 | 3/1979 | Germany . | |
| 394459 | of 0000 | United Kingdom . | |
| 2017042 | 9/1979 | United Kingdom . | |

*Primary Examiner*—Gary E. Elkins

*Attorney, Agent, or Firm*—Marshall, O'Toole, Gerstein, Murray & Borun

[57] ABSTRACT

The peripheral wall of a box is formed as a band with abutting ends (12,13) at a joint (35), the abutting ends being secured together by means of a tongue (26) which is provided at one end of the band entering into a recess (30) provided at the other end of the band. Preferably, the tongue (26) is formed as an extension of a lateral marginal portion (24) of the band-forming material which is folded over the adjacent main portion (11) thereof, and the recess (30) being defined between the folded-over marginal portion (24) and the adjacent portion (11) at the opposite end (12) of the band. Preferably also end portions (16,17) of the band are folded inwardly at the joint (35).

15 Claims, 5 Drawing Sheets

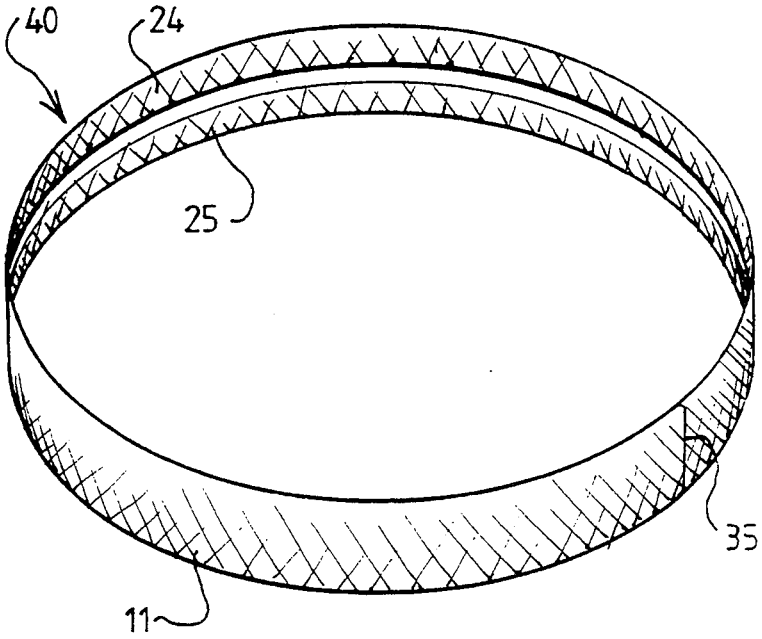
FIG 4
FIG 5
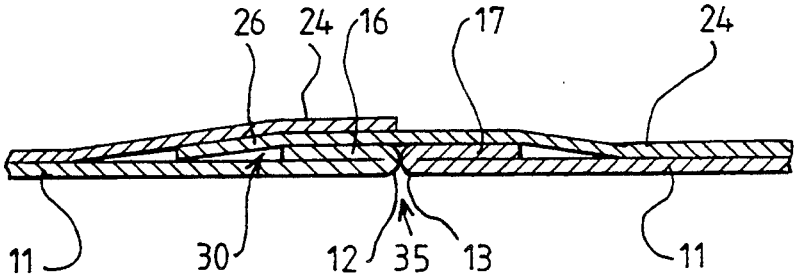

BOXES

DESCRIPTION OF INVENTION

This invention relates to rigid boxes made of cardboard or like materials and of the kind used primarily for the packaging of various types of product.

There is currently a requirement for rigid boxes suitable for the packaging of expensive consumer products. Traditionally, such boxes are formed from cardboard or the like which is covered with materials such as printed paper, fabric or foils.

One of the main limitations of traditional rigid box manufacture is the shapes that can be produced economically without resorting to expensive hand covering. For round and oval boxes typically a strip of board for this purpose is formed into a band by securing opposed ends together. It is difficult to form the required joint accurately by hand and where opposite ends of the band overlap it is difficult to avoid raw edges or bulges that are visible and detract from the appearance of the finished box.

Spirally wound or convolute wound boxes can be formed into rounds or ovals using a curled edge formed with a heated tool but limitations on size and shape and relatively high tooling costs restrict what can be offered.

It is an object of the present invention to provide an improved construction of rigid box which overcomes or reduces such problems.

According to the invention the peripheral wall of a box is formed from a continuous strip of material wherein at least adjacent to one end of the strip, a lateral marginal portion of such material is folded over an adjacent portion of the strip and secured relative thereto, the folded marginal portion at said one end of the strip defining in combination with said adjacent portion a recess, and the other end of the strip affording a tongue adapted to enter said recess, whereby the two ends of the strip may be brought together in abutting relation to form a continuous band by locating said tongue in said recess.

Preferably the tongue is off-set from said adjacent portion of the strip by a distance at least approximately equal to the thickness of the strip material so as to define a shoulder between the end of said adjacent portion and the tongue.

Most conveniently the tongue is formed at least in part as a longitudinal extension of said lateral marginal portion at the end of the strip opposite that at which the recess is formed. Alternatively or additionally the tongue may be formed at least in part as a longitudinal extension of a portion of the strip adjacent to said lateral marginal portion.

The lateral marginal portion of the strip may be folded over along the entire length thereof, and preferably longitudinal marginal portions are folded over at both longitudinal edges of the strip into either overlapping or non-overlapping relationship with each other. In the latter case, where the folded-over marginal portions do not overlap one another, the tongue and the recess may each comprise two parts, one part associated with each longitudinal marginal portion. However, in some cases each longitudinal marginal portion may afford a respective tongue and a respective recess. In such a case both tongues may be provided at the same end of the strip, and both recesses at the other end.

However, a tongue and a recess may be provided at each end of the strip if desired.

Whilst the tongue is most conveniently formed as an integral extension of the strip, it may be formed from an additional piece of material secured to the strip. For example there may be a recesses formed at each end of the strip and a connecting piece affording a pair of said tongues may be secured in the two recesses.

The recess is preferably formed as an open sided pocket defined by a part of the lateral marginal portion overlying the adjacent portion of the strip. Alternatively the recess may be formed as rebate defined by a cut-away end portion of the lateral marginal portion.

In accordance with a particularly preferred feature of the invention, portions of the material at the opposite ends of the strip are folded over and secured to adjacent portions thereof to form a double thickness abutting edge prior to the folding over of the longitudinal marginal portion or portions.

The material preferably comprises a board material which has a decorative finish on one surface thereof, namely that which is presented outwardly in the finished box. Such decorative finish may afforded by printing, or by laminating a foil or fabric material to the board material. It will be appreciated that in accordance with the preferred form of the invention both the longitudinal edges and the abutting end edges of the band are formed from folded material, so that there are no raw edges.

A particularly significant feature of the invention is the fact that the ends of the band can be brought into abutting relation because the tongues are formed as extensions of the folded-over longitudinal marginal portions of the material and are therefore not disposed in the same plane as the outer surface of the band.

In accordance with a further significant feature of the invention straight locating faces are preferably formed on the tongue so as to engage the sides of the recess and thereby locate the longitudinal edges of the band in accurate alignment at the joint.

The invention further resides in a method of forming the peripheral wall of a box by bringing the ends of a strip of wall-forming material together in abutting relation and forming a joint by means of a tongue, which is provided at one end of the strip, entering into a recess which is provided at the other end of the strip.

These and other features of the invention will now be described by way of example with reference to a preferred embodiment as described in the accompanying drawings, wherein:

FIG. 4 shows, in perspective view, a circular band formed from the blank;

FIG. 5 shows a longitudinal section through a butt joint formed in the band;

Figure 3:
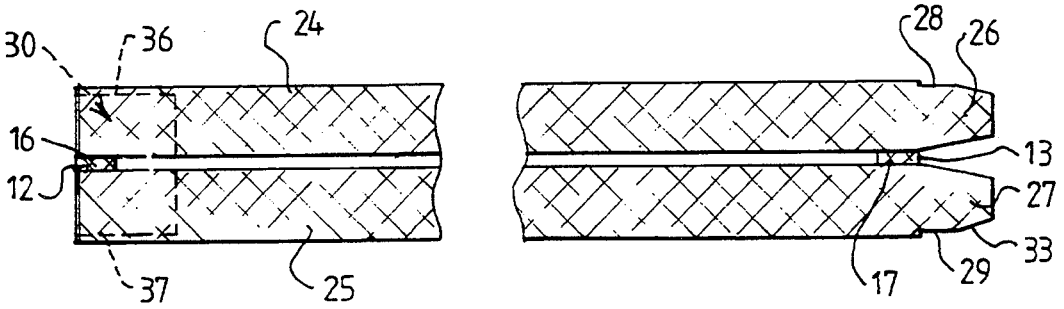
FIG. 3 shows the blank after a second folding operation.
Figure 6:
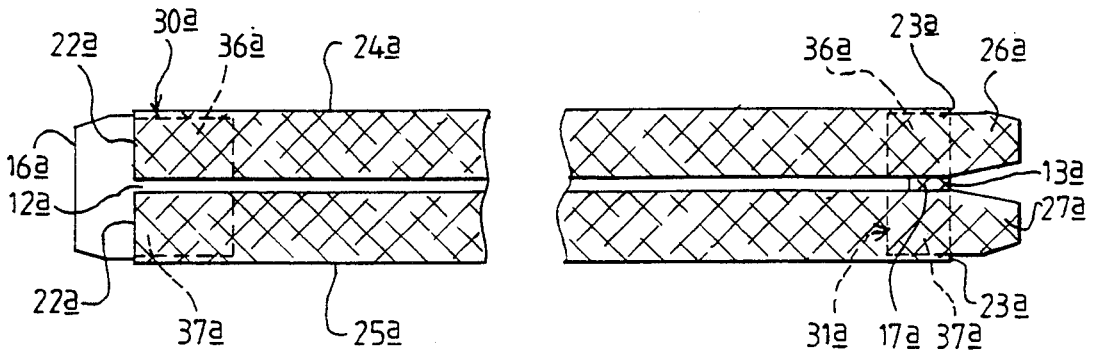
Figure 7:
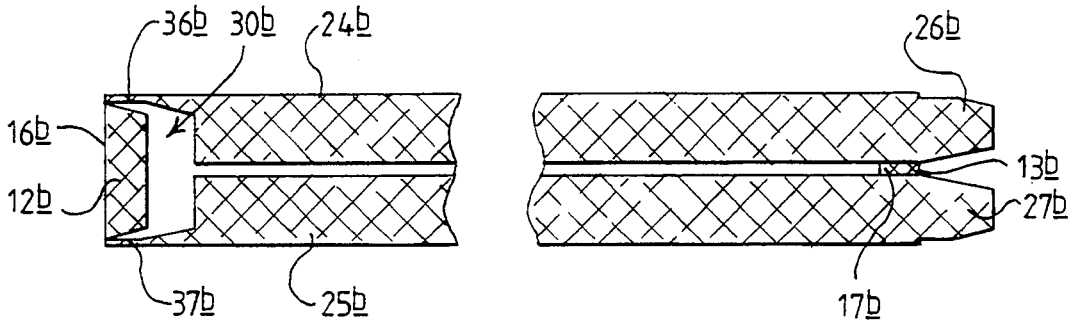
Figure 8:
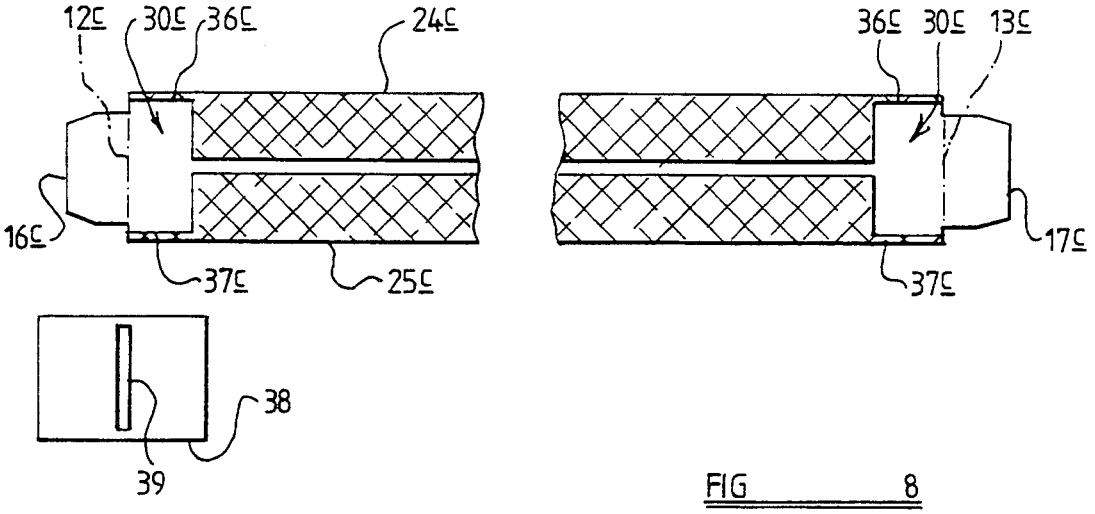
Figure 9:
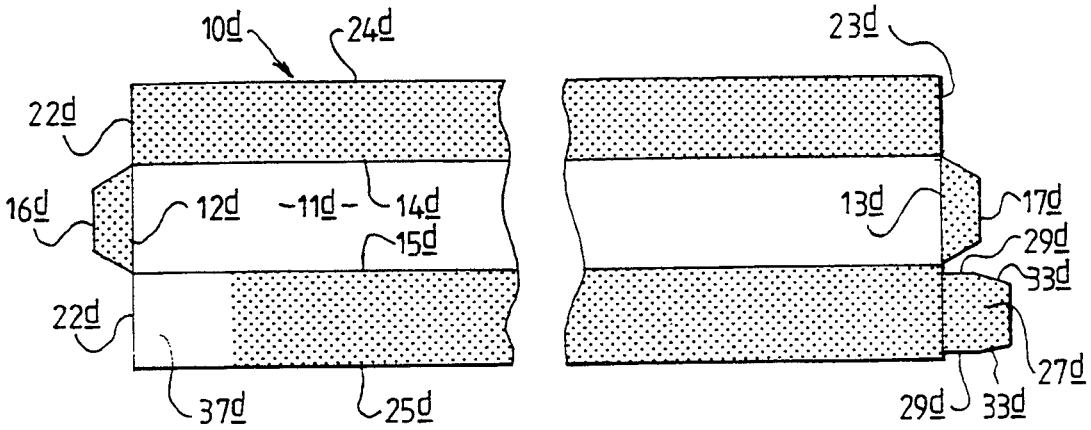
Figure 10:
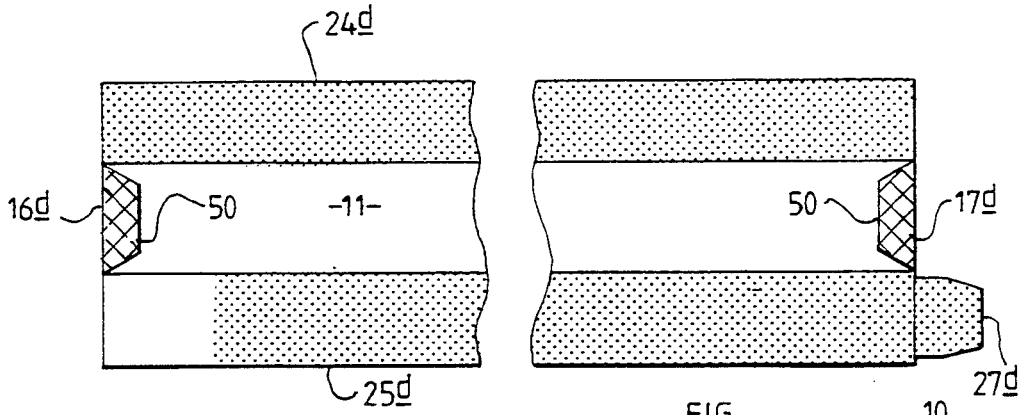
Figure 11:
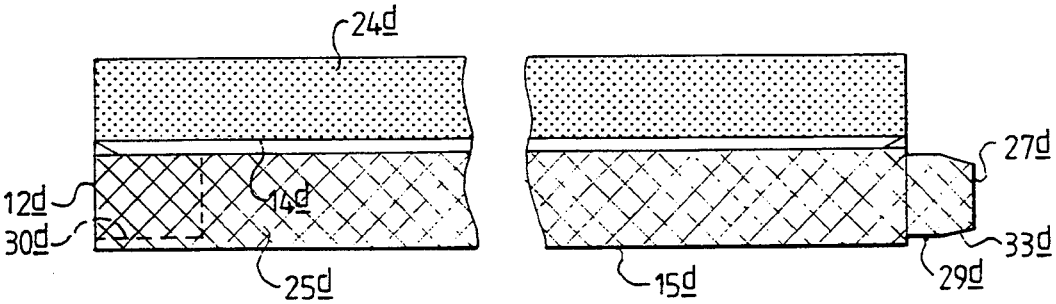
Figure 12:
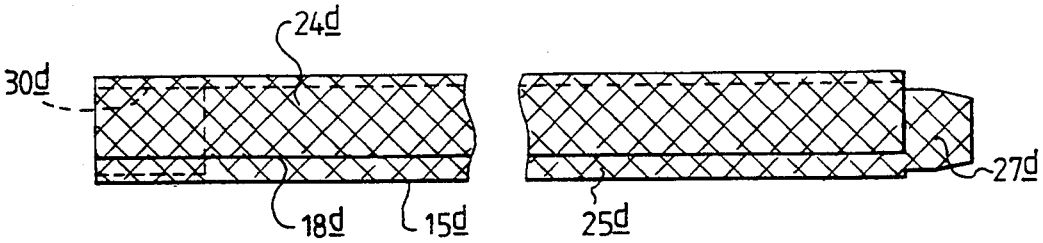
Figure 13:
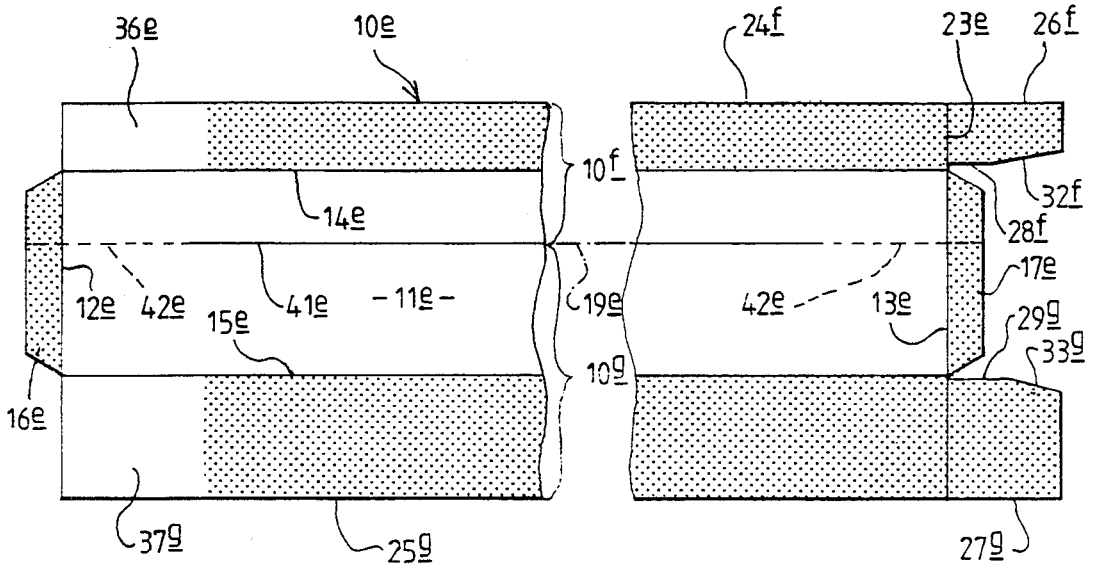

FIGS. 6, 7 and 8 respectively illustrate alternative embodiments of blank in view similar to that of FIG. 3, i.e. prior to bending to form a band;

FIG. 9 shows a plan view of a further embodiment of blank;

FIGS. 10, 11 and 12 respectively illustrate stages in the folding of the blank shown in FIG. 9;

FIG. 13 shows a plan view of a further embodiment of blank; and

Figure 14:
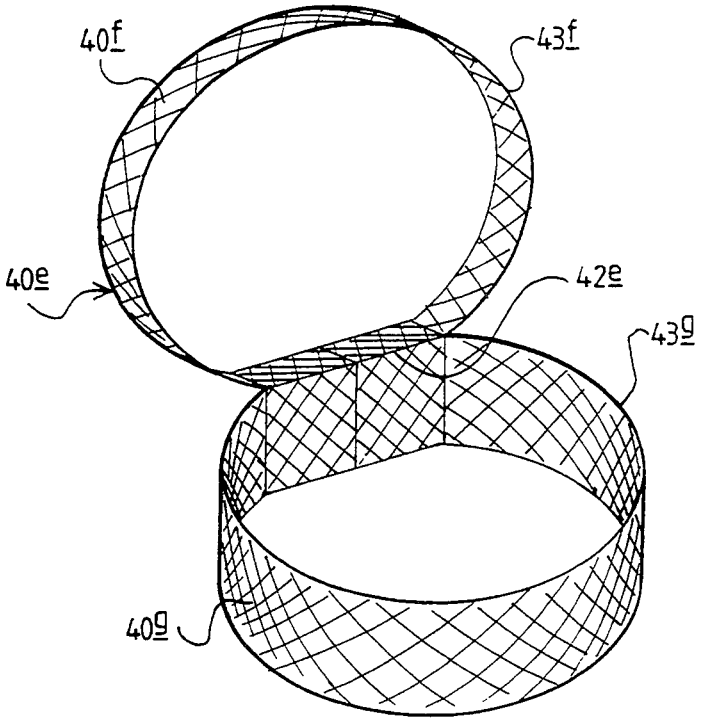

FIG. 14 shows, in perspective view, a band formed from the blank shown in FIG. 13.

Figure 1:
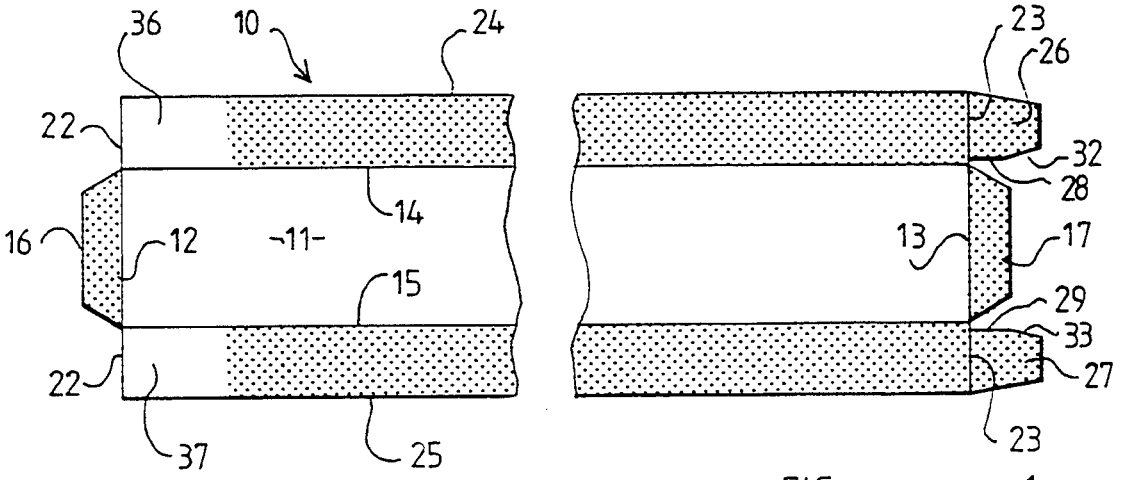
FIG. 1 shows a plan view of a preferred embodiment of blank from which the peripheral walls of a carton are to be made.

As illustrated in FIG. 1, in a preferred embodiment, a flat blank 10 is cut from a sheet of board material by any conventional means and scored or creased as appropriate to define the various panels, flaps and tongues hereinafter described. FIG. 1 shows the reverse face of the blank, i.e. that which will be presented inwardly of the finished box, and the outer face, which is not visible in FIG. 1, is provided with a decorative finish, which may be achieved by printing onto that face, or preferably by securing thereto a layer of decorative material such as a foil or fabric. It will be understood that the sheet from which the blank is cut is printed or laminated with such decorative material prior to the cutting of the blank 10. In the accompanying drawings the decorative layer 50 is shown cross-hatched.

As can best be seen from FIG. 1, the blank includes a main longitudinal panel 11 of generally strip-like form with a length between its opposed ends 12 and 13, corresponding to the peripheral length of the walls of the box to be formed therefrom, and a width between its opposed longitudinal edges 14,15 corresponding to the height of the peripheral wall.

At each end a transverse flap 16,17 is formed as a short extension of the main panel 11 and foldably connected thereto along the respective end edge 12,13. On the reverse face, as illustrated, the flaps 16 and 17 are coated with an appropriate adhesive as indicated by stipple shading.

At the opposed longitudinal edges, respective lateral panels 24,25 are provided as lateral extensions of the main panel 11, and foldably connected thereto along the longitudinal edges 14,15 respectively. The end edges 22,23 of the lateral panels are formed as in-line extensions of the end edges 12,13 of the main panel 11. However, each lateral panel 24,25 carries at the end edge 23 a respective tongue 26,27 formed as a longitudinal extension and foldably connected to the respective lateral panel 24,25 at the end edge 23.

Appropriate adhesive material, as indicated by stipple shading, is applied to the reverse surface of the lateral panels 24,25 over most of their length from the ends of the tongues 26,27 towards, but not up to, the opposite end edges 22, leaving respective adhesive-free areas adjacent the end edges 22, such areas having a length somewhat greater than that of the tongues 26,27 and being indicated in FIG. 1 at 36,37.

It will be appreciated that where the unseen front surface of the blank 10 is provided with a layer of facing material, particularly in the nature of a fabric, raw edges of that facing layer will be present around the entire periphery of the blank, but there will be no such raw edges along the longitudinal edges 14,15 and the end edges 12,13 of the main panel 11.

Figure 2:
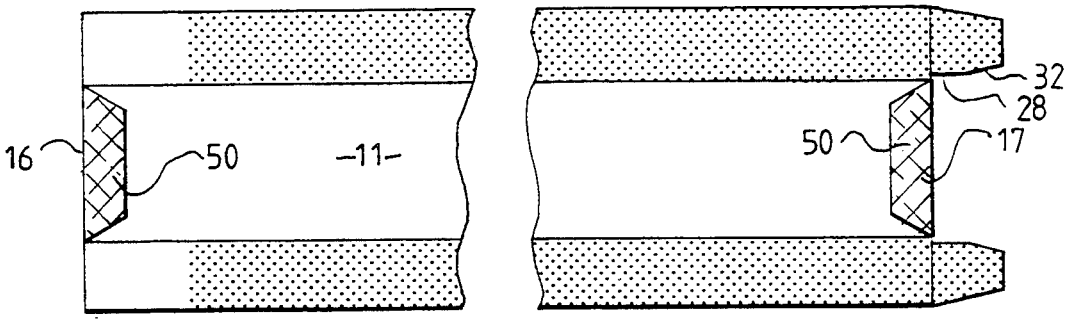
FIG. 2 shows the blank after a first folding operation.

To form a continuous band which will be used to form the peripheral walls of the finished box, the flaps 16 and 17 are first folded inwardly about the respective end edges 12,13 so as effectively to wrap the decorative layer of facing material 50 around those edges, as shown in FIG. 2. The lateral panels 24,25 are then folded inwardly along the respective lateral edges 14,15 to bring the blank into the condition shown in FIG. 3, in which the tongues 26 and 27 project longitudinally beyond the end edge 13 of the main panel 11, but are rearwardly offset therefrom, as can most clearly be seen in FIG. 5. There is thus a distinct shoulder between the now outwardly facing reverse surface of the flaps 26 and 27 and the folded end edge 13 of the main panel.

At the opposite end of the main panel 11, the adhesive-free areas 36,37 of the folded-over lateral panels 24,25, in combination with the adjacent portions of the main panel 11, define a pocket 30 which is open at the end edge 12 of the main panel, for the reception of the tongues 26,27.

To form the band 40 as illustrated in FIG. 4 the two ends of the main panel 11 are simply brought together by bending the panel (with the folded-over lateral panels 24,25 on the concave side) and inserting the tongues 26,27 in the pocket 30 at the opposite end, until the folded end edges 12,13 are in directly abutting relation, to form a butt joint 35 which ensures that the circumferential length of the band corresponds exactly to the desired dimension and avoids the problem of variable overlap previously encountered when hand-forming bands simply by overlapping opposite ends of an elongated strip of material.

Due to the adhesive provided on the reverse face of the tongues 26,27, the tongues will adhere to the reverse face of the main panel 11 when they are inserted into the pocket 30. Preferably, additional adhesive, is applied during the assembly step to the front faces of the tongues 26,27 so as to cause them also to adhere to the reverse face of the lateral panels 24,25 in the areas 36,37 which were originally free of adhesive in order to define the required pocket 30 for the reception of the tongues.

In accordance with a further preferred feature of the invention, in order to ensure accurate alignment of the top and bottom edges of the band 40 at the joint 35, the tongues 26 and 27 are formed with respective straight locating edges 28,29 which are disposed parallel to the respective lateral edges 14,15 of the main panel 11 and offset therefrom by a distance commensurate with the thickness of the material. In this way, the spacing between the opposed locating edges 28 and 29 is arranged to correspond very closely to the internal width of the pocket 30 defined at the opposite end of the panel 11 between the inner faces afforded by the folded edges 14,15.

Preferably, the locating edges 28,29 extend only over part of the length of the tongues 26,27, and over the remainder of the length an oblique edge face 32,33 is provided. The oblique edge faces 32,33 in combination define a lead-in portion which facilitates insertion of the tongues 26,27 into the pocket and ultimate alignment of the lateral edges 14,15 at opposite ends of the main panel 11 by engagement of the locating edges 28,29 inside the folded edges 14,15 as the folded end edges 12,13 are brought together to form a neat butt joint 35 as illustrated in FIG. 4.

It will particularly be observed from FIG. 4 that the butt joint 35 is formed by the abutment of the folded end edges 12,13 of the main panel 11 so that there is no raw edge to the decorative layer 50 of facing material at the joint. Likewise, the top and bottom edges of the band 40 are defined by the folded edges 14,15, and again there is no raw edge of the decorative layer 50 visible.

Whilst, as illustrated, the band 40 is of simple, circular shape, it will be understood that it may be formed into any desired shape, including elliptical, D-shaped, or polygonal, in the latter case appropriate transverse fold lines being formed in the blank 10 and, if necessary, the band being constructed around an appropriately shaped former to produce the required band configuration.

The finished product thus has a particularly well-finished appearance, and a complete absence of raw edges or bulges caused by overlapping materials visible externally.

In most cases, in order to complete the peripheral wall assembly, a slightly shorter band will be provided to nest within the band 40. Preferably, this inner band will be formed in a similar manner to the band 40 and in this case the folded blank would be bent in the opposite sense (i.e. with the folded-over lateral panels on the convex side) so that the uninterrupted, decorated surface of the main panel is presented inwardly of the band. The inner band is then secured in position within the outer band, with one circumferential edge thereof spaced slightly inwardly relative to the adjacent circumferential edge of the outer band 40 in order to form an internal shoulder which extends around the entire periphery of the composite band. A cover or base member of corresponding peripheral shape may then be located, and secured for example by adhesive, on the internal shoulder to complete the construction and form a rigid assembly, in a generally conventional manner.

In conventional manner, the inner band may be of such a width, relative to the outer band, that at the edge opposite that at which it defines the internal shoulder for the reception of the cover or base member, it is spaced from that opposite edge of the outer band either inwardly so as to define an annular recess or outwardly so as to define an annular rim and thereby provide complementary lid and base portions which can be assembled together by means of such rim engaging in such recess.

A band constructed and as illustrated in FIGS. 1 to 5 of the accompanying drawings represents a basic embodiment of the invention, which forms the periphery of a simple box lid or base. However, there are many possible variations on this basic design. For example, if desired, instead of providing both tongues 26,27 both at the same end edge 13 of the main panel 11, it would alternatively be possible for the tongue 27 to be provided at the opposite end 22 of the lateral panel 25, with the corresponding adhesive-free area 37 then being disposed adjacent to the end edge 23 of the panel 25. In some cases it may be sufficient to provide only a single tongue 26 or 27.

The width of the lateral panels 24,25 may be varied, so that the edges thereof may be arranged to overlap one another or to meet along the centre line of the main panel 11, instead of being spaced apart slightly as shown in the illustrated embodiment, or, particularly where the main panel 12 is of relatively greater width than illustrated, the lateral panels may be relatively narrower so as to overlap a smaller area of the main panel.

Whilst the folded-over edges 14,15 are particularly desirable for the reasons previously mentioned, in some cases it may be sufficient to provide the lateral panels only at positions immediately next to the ends of the main panel for the purpose of carrying the tongues and forming the tongue-receiving pockets, for example where forming a band from material which is not provided with a decorative finish on one face, or for applications where a raw edge to a decorative layer can be accepted. In some cases the flaps 16,17 may be omitted under similar circumstances.

Moreover, the lateral edges 14,15 of the main panel 11 need not be straight and parallel as illustrated, but could diverge. More particularly, either or both of the edges 14,15 may be defined by several shorter straight portions, each angled relative to the adjacent portion, the lateral panels 24,25 then being sub-divided into a series of separate sub-panels corresponding to each of the straight portions, and having appropriately angled end faces to prevent overlap of adjacent sub-panels when folded over into contact with the adjacent main panel 11.

Moreover, while it is in many cases desirable that the tongues 26,27 should be formed from board laminated with the decorative material for reasons of strength and appearance, in some cases sufficient strength may be obtained if the tongues 26,27 are formed only by the decorative material. For example a rectangular strip of board corresponding to the main panel 11 may have secured thereto a wrapper of decorative material which corresponds in shape to the blank 10 shown in FIG. 1 so that in this case the lateral panels 24,25, tongues 26,27 and flaps 16,17 are afforded solely by the decorative material.

Such variations may where appropriate also be applied to the further embodiments described below.

Other embodiments will now be described with reference to FIGS. 6 to 14 of the accompanying drawings. In relation to these other embodiments, the same reference numerals as used in the preceding Figures are used to denote similar parts, but with the addition of the suffixes a,b,c,d,e,f and g as appropriate. Accordingly, the foregoing description, so far as appropriate, is also applicable to such other embodiments, which will hereinafter be described only with regard to the differences from the embodiment illustrated in FIGS. 1 to 5.

In FIG. 6, areas 36*a* and 37*a* are left free from adhesive at both ends 22*a*,23*a* of the lateral panels 24*a*,25*a*, and flap 16*a* at the end 12*a* of the main panel opposite to the end 13*a* at which the tongues 26*a*,27*a* are provided is left unfolded, and may also be of relatively greater width in the direction of the length of the main panel. A double fold-line may be formed at the end edge 12*a* of the main panel so that the flap 16*a* is offset from the plane of the main panel like the tongues 26*a*,27*a*. To form a continuous band, as in the previously described embodiment, the tongues 26*a*,27*a* are inserted into the open ended pocket 30*a* defined by the initially adhesive-free areas 36*a*,37*a* adjacent to the end edge 12*a*, and at the same time the flap 16*a* is inserted into a complementary pocket 31*a* defined by the initially adhesive-free areas 36*a*,37*a* adjacent to the tongues 26*a*,27*a*, adhesive being applied as necessary to hold the two ends of the band together.

In FIG. 7 instead of leaving unglued areas at the ends of the lateral panels 24*b*,25*b* remote from the tongues 26*b*,27*b*, end portions 36*b*,37*b* are cut away so that in combination, when the lateral panels 24*b*,25*b* are folded over the main panel, they define a recess 30*b*. When the ends 12*b*,13*b* of the main panel are brought together to form the band, the tongues 26*b*,27*b* are located within the recess 30*b* and glued in position.

In a further variation, not illustrated, which employs a recess similar to 30*b* rather than an open sided pocket similar to 30*a*, an unfolded tongue similar to 16*a* may be provided at one end of the main panel, while at the opposite end of the main panel the lateral panels may be cut away to define a recess similar to 30*b*, so that in such a case the tongue is received within the recess when the two ends of the main panel are brought together.

In FIG. 8 end portions 36*c*,37*c* of the lateral panels 24*c*,25*c* are cut away at both ends so as to form a recess 30*c* at each end of the main panel. Flaps 16*c*,17*c* are formed as integral extensions of the main panel at the opposite end edges 12*c*,13*c*, similar to the flaps 16*a* of the FIG. 6 embodiment. To join the two ends of the main panel together in order to form a continuous band, a connection piece 38 is provided, of such a size as to fit within the rebate afforded by the two recesses 30*c*. The connection piece 38 is formed with a central slot 39 of such a width that the flaps 16*c*,17*c* may be bent inwardly and passed through the slot 39. The flaps 16*c*,17*c* are then folded back over the connection piece 38, adhesive as necessary being applied to the flaps and the connection piece in order to secure the ends of the main panel together.

In the above-described embodiments, the main panel 11 affords lateral panels 24,25 at both of its longitudinal edges and such lateral panels are folded over and adhered to the main panel so that the band formed therefrom consists essentially of two layers of board material. However, it is possible to employ lateral panels of transverse width similar to that of the main panel so that a three-layer construction is achieved when the lateral panels are folded inwardly. Such an embodiment is illustrated in FIGS. 9 to 12 of the accompanying drawings. In this case, the lateral panel 25*d* is only slightly narrower than the main panel 11*d*, while the lateral panel 24*d* is somewhat narrower still, and only a single tongue 27*d* is provided, i.e. at one end of the wider lateral panel 25*d*, as shown in FIG. 9. The tongue 27*d* is of symmetrical shape and is formed with a pair of parallel locating edges 29*d* and converging oblique edge faces 33*d*.

As in the first embodiment, flaps 16*d*,17*d* at the ends 12*d*,13*d* of the main panel 11*d* are folded inwardly as shown in FIG. 10, and adhesive is applied to the lateral panels 24*d* ,25*d*as indicated by the stipple-shaded areas, namely over the entire length of the narrower lateral panel 24*d*, and over most of the length of the wider lateral panel 25*d* from the outer end of the tongue 27*d* to a position spaced from the opposite end 22*d* by a distance somewhat greater than the length of the tongue 27*d* to leave an adhesive-free area 37*d*.

The wider lateral panel 25*d* which carries the tongue 27*d* is then folded over the main panel 11*d*, as shown in FIG. 11, to bring the tongue 27*d* into a position in which it forms an off-set extension at the end 13*d* of the main panel 11*d* and to form a pocket 30*d* at the end 12*d* of the main panel 11*d* in which the tongue 27*d* can be received. If desired, at least a part of the adhesive-free area 37*d* may be cut-away to receive the tongue 27*d* in the same plane as the wider lateral panel 24*d*, instead of between the latter and the main panel, to reduce the thickness of the joint which is formed when the ends of the main panel 11*d* are brought together.

To complete the assembly, the narrower lateral panel 24*d* is folded over and adhered to the folded-over wider lateral panel 25*d*. As can be seen from FIG. 12, the free edge 18*d* of the narrower lateral panel 24*d* is spaced slightly inwardly from the folded edge 15*d* of the main panel to form a shoulder, which when the blank is formed into a band will serve as a seating to receive a cover or base member. Thus, this embodiment obviates the need for a second, internal band as required in the embodiments illustrated in FIGS. 1 to 8.

In a variation, not illustrated, a similar band may be formed using only a double thickness of board material, by omitting the wider lateral panel 25*d* entirely, forming a tongue at one end of the single lateral panel 24*d* and leaving an adhesive-free area at the opposite end of the single lateral panel. Thus, when the single lateral panel is folded over the main panel, the tongue forms an off-set extension of the main panel for reception in a pocket defined by the adhesive-free area at the opposite end of the main panel, and the free edge of the single extension panel affords a shoulder for seating the cover or base member.

In a similar manner, in forming a particularly narrow internal band the main panel may be provided with a lateral panel along only one longitudinal edge; whilst this leaves a raw edge of the decorative layer exposed at the opposite longitudinal edge, this would be acceptable since that edge will not be visible in the finished box. Alternatively, a narrow lateral panel, (similar to the flaps at the end edges of the main panel) might be provided along such longitudinal edge in order to avoid a raw edge of the decorative layer while still utilising only one tongue to form the joint.

In a further variation, not illustrated, the flap 17*d* adjacent to the tongue 27*d* is not folded over onto the main panel 11*d*; only the flap 16*d* at the other end of the main panel being folded over. In this case, when the lateral panel 25*d* which carries the tongue 27*d* is folded over the main panel 11*d*, the tongue 27*d* overlies the flap 17*d*, but otherwise at this stage the arrangement is substantially as illustrated in FIG. 11, although the flap is in this case shaped in correspondence with the tongue. The assembly is completed by folding the other lateral panel 24*d* inwardly over the previously folded lateral panel 25*d*. Again, an open-ended pocket 30*d* is formed at the end 12*d* of the strip between the infolded flap 16*d* and the infolded panel 25*d* to receive the double thickness tongue afforded by tongue 27*d* and flap 17*d* in combination. In this case, it is not necessary for adhesive to be applied to the rear face of the lateral panel 25*d* which carries the tongue 27*d*, since adhesive on the rear face of the other lateral panel 24*d* will serve to hold the strip in its folded condition by virtue of engagement of the lateral panel 24*d* with the lateral panel 25*d*.

Whilst the above-mentioned embodiments are suitable for the construction of separate lid and base portions of a box, those portions either being fully separable or being subsequently secured together in any appropriate manner to form a hinged assembly, it is alternatively possible to form such a hinged assembly from a single blank, as illustrated by way of example in FIG. 13.

In this case, the blank 10*e* is shown in a form generally similar to that shown in FIG. 1, but the blank 10*e* is sub-divided longitudinally on a line 19*e* into lid and base portions 10*f*, 10*g* by means of a cut 41*e* which extends on the line 19*e* over most of the length of the main panel 11*e* and by means of creases 42*e* which extend from the ends of the cut 41*e* across the ends 12*e*, 13*e* of the main panel and across the flaps 16*e*, 17*e* to the opposite end edges of the blank. As can be seen, in this example, the line 19*e* is somewhat off-set from the longitudinal centre line of the blank so that the lid portion 10*f* is of somewhat shallower depth than the base portion 10*g*.

The band 40*e* is formed in exactly the same way as described in relation to FIGS. 2 to 5, but the longitudinal portion of the band in which the creases 42*e* are located is kept flat so that the creases can serve as a hinge. To further facilitate this, instead of extending the creases across the flaps 16*e*,17*e*, the later may be cut along the line 19*e*. If required, the joint may be strengthened by means of an additional piece of board material overlying each of the tongues 26*f*, 27*g* and the adjacent areas of the lateral panels 24*f*,25*g*. Such strengthening members may comprise separate pieces of board material secured in place by adhesive, or lateral extensions of the flaps 26*f*,27*g* and the adjacent end portions of the lateral panels 24*f*,25*g* folded over and secured adhesively in face-to-face relation therewith.

The remaining longitudinal portion of the blank in which the cut 41*e* is located may be formed to any desired shape, and by way of example a uniformly curved shape is shown in FIG. 14, although non-uniform curves and polygonal shapes may, of course, be employed. By virtue of the cut 41*e*, the lid and base portions 40*f*,40*g* of the formed band 40*e* can be separated by hinging action about the creases 42*e*, as illustrated in FIG. 14.

To complete the box, the lid and base portions 40*f*,40*g* are each provided with a respective internal band and a lid or base member (not shown). Such internal bands may be formed separately or in a similar manner to the outer bands from a single blank, and each is located within the respective lid and base band so as to form an internal shoulder for the reception of a lid or cover member to form the top and bottom of the completed box. The inner band for the lid portion 40*f* may be of such width as to leave an internal rebate along the opening edge 43*f* defined by the cut 41*e*, and the inner band for the base portion 40*g* may be of such a width as to form a rim projecting beyond the opening edge 43*g* defined by the cut 41*e*, the projecting rim of the inner band of the base portion entering the rebate of the lid portion when the box is closed. When the inner band is made in one piece, this can be achieved by off-setting the cut relative to the creases by a distance corresponding to the width of the required projecting rim.

I claim:

1. A box comprising a peripheral wall formed from a continuous strip of material having longitudinally opposite ends wherein:

lateral marginal portions of said material are folded over adjacent portions of the strip between said marginal portions and do not overlap one another, the lateral marginal portions being adhesively secured to said adjacent portions;

the folded marginal portions at one of said ends of the strip defining in combination with said intermediate portions a recess;

the other of said ends of the strip is formed with a tongue which is adapted to enter said recess, the ends of the strip being in abutting relation to form a joint with said tongue located in said recess; and the tongue and the recess each comprise two parts associated with the respective longitudinal portions.

2. A box as claimed in claim 1 wherein the recess is formed as a pocket defined by the lateral marginal portions and the respective adjacent portions of the strip, with an opening at said one end of the strip.

3. A box as claimed in claim 1 wherein the recess is defined by cut-away end portions of the lateral marginal portions and the respective adjacent portions of the strip.

4. A box as claimed in claim 1 wherein portions of the material at the opposite ends of the strip are folded over and secured to adjacent portions of the strip, prior to the folding over of longitudinal marginal portions, to form a double thickness abutting edge at the joint.

5. A box according to claim 1 wherein the strip is formed from a board material which has a decorative finish on one surface thereof which is presented outwardly in the finished box.

6. A box comprising a peripheral wall formed from a continuous strip of material having longitudinally opposite ends wherein:

at least adjacent to one of said ends of the strip a lateral marginal portion of such material is folded over an adjacent portion of the strip and adhesively secured thereto;

the folded marginal portion at one of said ends of the strip in combination with said adjacent portion defines a recess;

the other of said ends of the strip is provided with a tongue formed as a separate piece of material secured to the strip and adapted to enter said recess, the two ends of the strip being in abutting relation to form a joint with said tongue located in said recess.

7. A box as claimed in claim 6 wherein the recess is defined by a cut-away end portion of the lateral marginal portion in combination with the adjacent portion of the strip.

8. A box as claimed in claim 6 wherein portions of the material at the opposed ends of the strip are folded over prior to the folding over of the longitudinal marginal portion to form a double thickness abutting edge at the joint.

9. A box comprising a peripheral wall formed from a continuous strip of material having longitudinally opposite ends, wherein:

a lateral marginal portion of such material is folded over an adjacent portion of the strip and adhesively secured thereto;

the folded marginal portion at both of said ends of the strip defines in combination with said adjacent portion respective recesses;

the two ends of the strip being held in abutting relation to form a joint by means of a connecting piece which is secured in the recesses.

10. A box as claimed in claim 9 wherein the recess is defined by a cut-away end portion of the lateral marginal portion in combination with the adjacent portion of the strip.

11. A box as claimed in claim 9 wherein portions of the material at the opposite ends of the strip are folded over through a slot formed in the connecting piece and secured to the connecting piece.

12. A box comprising a peripheral wall formed from a continuous strip of material having longitudinally opposite ends wherein:

a lateral marginal portion of such material is folded over an adjacent portion of the strip and adhesively secured thereto;

the folded marginal portion at one of said ends of the strip defining in combination with said adjacent portion a recess;

the other of said ends of the strip is formed with a tongue which is adapted to enter said recess, the two ends of the strip being in abutting relation to form a joint with said tongue located in said recess; and portions of the material at the opposed ends of the strip are folded over and secured to adjacent portions thereof prior to the folding over of the longitudinal marginal portions to form a double thickness abutting edge at the joint.

13. A box as claimed in claim 12 wherein the tongue is formed as a longitudinal extension of said lateral marginal portion at the other of said ends of the strip.

14. A box as claimed in claim 12 wherein the recess is formed as a pocket defined between the lateral marginal portion and the adjacent portion of the strip, with an opening at said one end of the strip.

15. A box as claimed in claim 12 wherein the recess is defined by a cut-away end portion of the lateral marginal portion in combination with the adjacent portion of the strip.

* * * * *